US005718180A

United States Patent [19]

Stutznäcker

[11] Patent Number: 5,718,180

[45] Date of Patent: Feb. 17, 1998

[54] MULTIPLE-NEEDLE SEWING MACHINE

[75] Inventor: Klaus Stutznäcker, Frechen, Germany

[73] Assignee: Nähmaschinenfabrik Emil Stutznäeker GmbH & Co., KG, Germany

[21] Appl. No.: 648,679

[22] Filed: May 16, 1996

[30] Foreign Application Priority Data

May 17, 1995 [DE] Germany ..... 195 18 063.1

[51] Int. Cl.[6] ..... D05B 55/02

[52] U.S. Cl. ..... 112/117; 112/163; 112/226

[58] Field of Search ..... 112/163, 117, 112/186, 279, 166, 167, 80.45, 80.44, 80.43, 223, 226

[56] References Cited

U.S. PATENT DOCUMENTS

| | | | |
|---|---|---|---|
| 2,319,829 | 5/1943 | Russell | 112/167 |
| 3,641,955 | 2/1972 | Brown et al. | 112/80.43 |
| 3,867,891 | 2/1975 | Grabher | 112/166 |
| 4,474,124 | 10/1984 | Yamazawa | 112/167 |
| 4,831,948 | 5/1989 | Itoh et al. | 112/80.43 |

FOREIGN PATENT DOCUMENTS

| | | | |
|---|---|---|---|
| 3420763 A1 | 12/1985 | Germany . | |
| 322448 | 12/1969 | U.S.S.R. | 112/166 |

*Primary Examiner*—Ismael Izaguirre

*Attorney, Agent, or Firm*—Liddell, Sapp, Zivley, Hill, LaBoon, LLP

[57] ABSTRACT

Multiple-needle sewing machines are equipped with at least one needle bar and with fixing device for the individual needles as well as with at least one looper shaft to which the looper holder with the loopers is fixed. In order to obtain quick and easy changeover of a multiple-needle sewing machine to different sewing patterns on a large area sewing material it is proposed that manually operated quick-locking means are provided between each needle or a needle holder for each needle and the needle bar and/or between the looper holder of each looper or each looper and the looper shaft.

12 Claims, 2 Drawing Sheets

MULTIPLE-NEEDLE SEWING MACHINE

FIELD OF THE INVENTION

This invention relates to a multiple-needle sewing machine comprising at least one needle bar and fixing means for the individual needles as well as at least one looper shaft having fixed to it looper holders with the loopers.

BACKGROUND OF THE INVENTION

Multiple-needle sewing machines for sewing large area material, such as quilts for example, are equipped with a great number of needles, namely up to 120 or even 140 needles per needle bar. If plural needle bars are provided, particularly two or three needle bars in common to the needle row, the number of needles correspondingly increases. Loopers are part of the individual needles and together with said needles represent the essential parts of the sewing elements. The loopers are fixed via looper holders to looper shafts jointly oscillating to and fro.

With such type of multiple-needle sewing machines a considerable problem arises due to the fact that the pattern to be sewn on the large area material must be changed quite frequently. For this purpose all of the needles or at least a major part thereof must be removed and mounted again in a different position of the corresponding needle bar. To prevent transverse running of the upper thread or even cross-overs of the upper threads the same frequently require to be previously cut through. Up to present the needles are fixed to the needle bar mostly by means of complicated screwed connections so that tools and very often special tools are required for dismounting the needles and remounting them in different positions because the fixing means are difficult to be accessed.

The same analogy applies also to the loopers or the looper holders with their under threads. Changeover of a multiple-needle sewing machine to a different sewing pattern is labor- and time-consuming for the reasons mentioned above.

SUMMARY OF INVENTION

The invention is based on the problem of providing a multiple-needle sewing machine which allows for a quick and simple changeover to a different sewing pattern.

Starting from a multiple-needle sewing machine as described at the beginning, the problem posed is solved by the provision of manually operable quick-locking means between each of the needles or a needle holder for each needle and the needle bar and/or between the looper holder of each looper or each looper and the looper shaft.

The essential advantage resides in that the quick-locking means for the above-mentioned sewing elements can be quickly and simply released by hand and can be locked again by hand as soon as the sewing elements have been transferred to a different position.

Embodiments of the invention are schematically represented by way of example in the attached drawings wherein:

DESCRIPTION OF THE PREFERRED EMBODIMENTS

Figure 1:
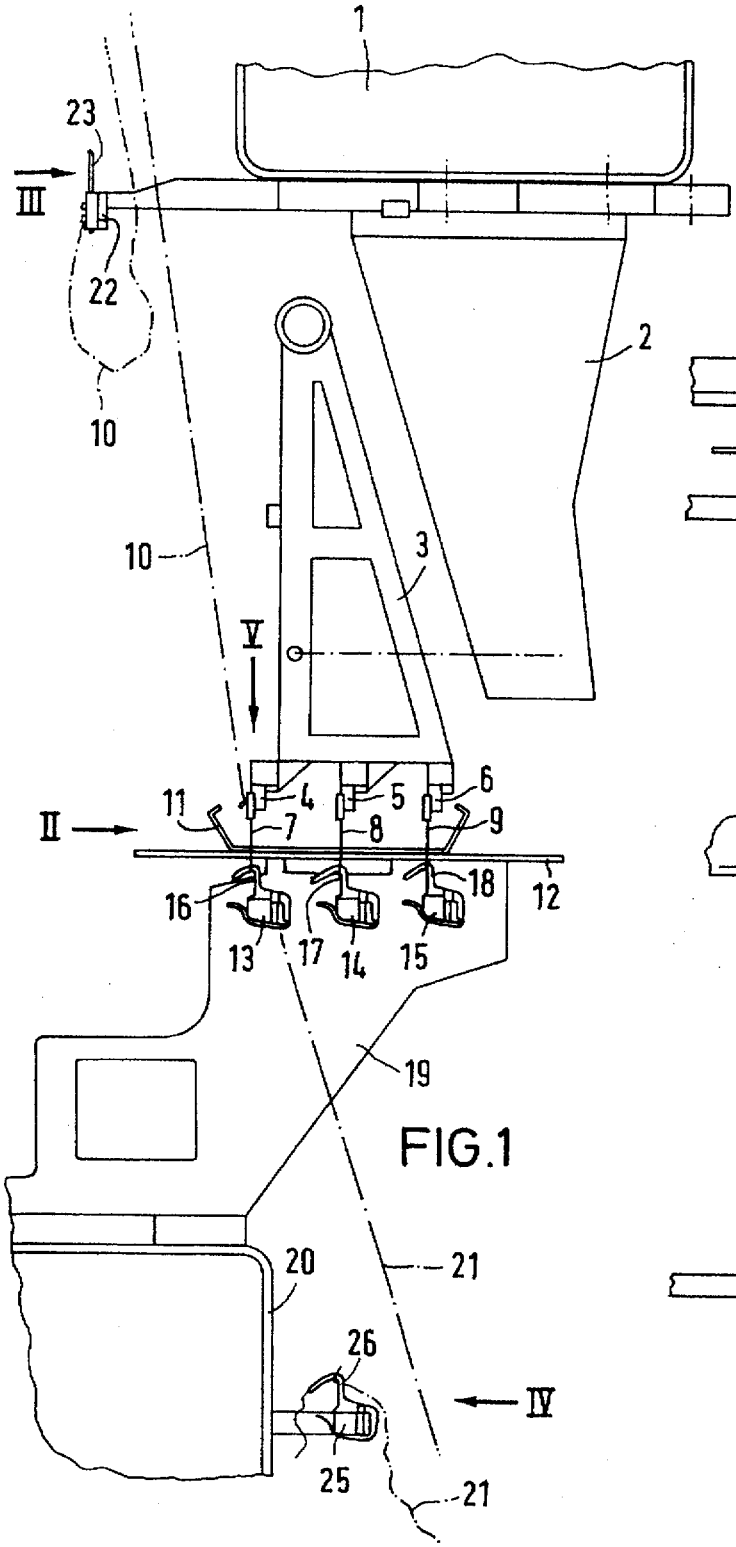
FIG. 1 is a lateral view of a part of a multiple-needle sewing machine.
Figure 2:
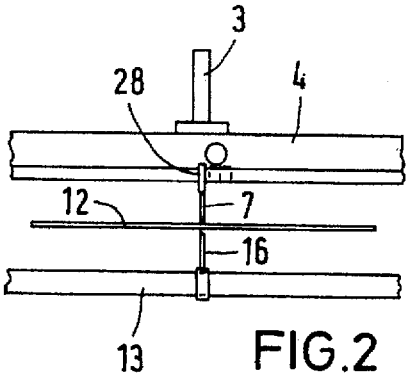
FIG. 2 is a partial front view in the direction of arrow II in FIG. 1.

The drawings, which are simplified for reasons of clarity, show the essential parts of a multiple-needle sewing machine comprising in a manner known per se an upper crosshead 1, an upper machine frame part 2 and a driven needle bar holder 3. In this embodiment, the needle bar holder 3 carries three mutually parallel needle bars 4, 5, 6 to which rows of needles are fixed vertically to the focal plane in FIG. 1. Accordingly, only the individual needles 7, 8, 9 at the front are to be seen in FIG. 1. The needles cooperate with upper threads of which, for the sake of simplicity, merely the upper thread 10 to needle 7 is shown. Reference number 11 designates a pressure foot and reference number 12 a part of the sewing material supporting plate or throat plate through which throat plate and through the material to be sewn, which is not depicted for the sake of simplicity, the needles can penetrate in up and down motions. The needles cooperate with loopers 16, 17, 18 which in association with the needles are mounted on looper shafts 13, 14 and 15 in rows vertical to the focal plane of FIG. 1. The looper shafts are supported on a lower machine frame part 19 which is built up on a lower crosshead 20. In each looper an under thread 21 is guided, but for the sake of simplicity only the under thread to looper 16 is indicated in FIG. 1.

Figure 5:
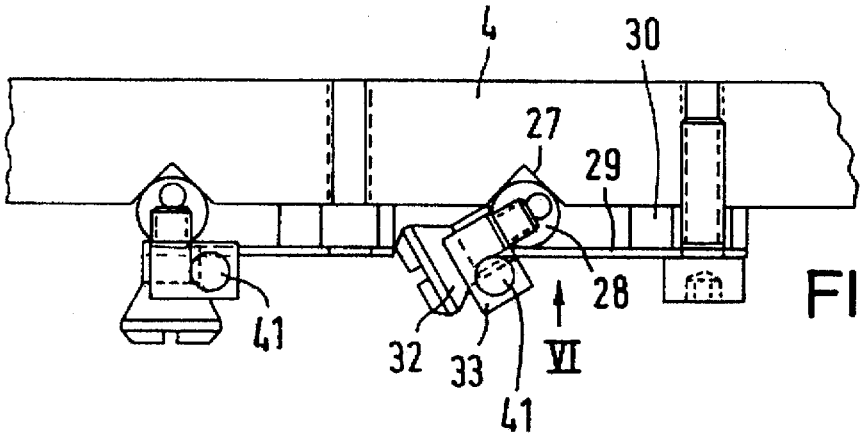
FIG. 5 is a partial top view in the direction of arrow V in FIG. 1 to an enlarged scale.
Figure 6:
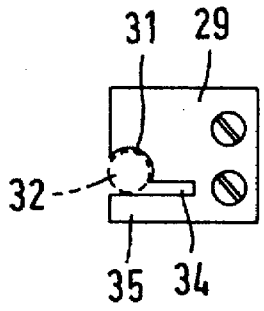
FIG. 6 is a partial view in the direction of arrow VI in FIG. 5 and representing a locking plate.
Figure 7:
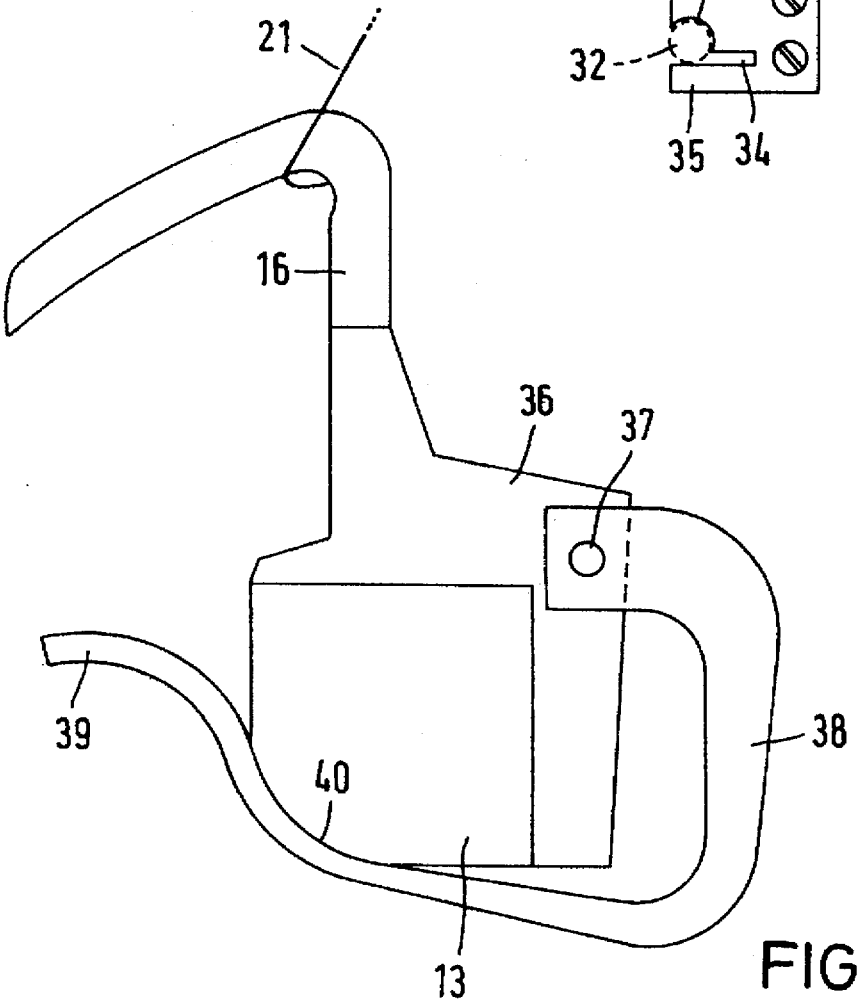
FIG. 7 is a lateral view, to an enlarged scale, of a looper shaft with loopers, looper holder and locking strap.

Both the individual needle holders and the individual loopers or looper holders are equipped with quick-locking means which are explained by way of FIGS. 5 to 7. According to the embodiment of FIGS. 5 and 6, the quick-locking means for each needle comprises a longitudinal guide 27 for the needle holder 28 provided on the needle bar 4 as well as an actuating pin 32 on the needle holder 28 pivotable in a direction transverse of the longitudinal guide, and finally a lock-in position for the actuating pin 32. In the one inclined pivot position of the actuating pin 32 shown in the middle of FIG. 5 the needle holder 28 can be pushed into the longitudinal guide 27 from below. In the other pivot position, shown in the left part of FIG. 5, the actuating pin 32 together with the needle holder 28 is locked in the longitudinal direction, i.e. in the direction vertical to the focal plane of FIG. 5.

Advantageously, the longitudinal guide 27 is formed of a notch in the needle bar 4 which is approximately triangular in cross-section and of a locking plate 29 covering said notch, the locking plate 29 expediently being fastened by screws to the needle bar 4 via a spacer 30. In this manner the needle holder 28 is supported on three generating lines which extend longitudinally, i.e. vertically to the focal plane of FIG. 5, and which are distributed over the circumference so that the needle holder 28 sits close without any motion. As shown by FIG. 6, the locking plate 29 has a laterally open semi-circular recess 31 forming the actual lock-in position. Said recess 31 is followed by a slot 34, whereby a slightly springy web 35 is formed so that the actuating pin 32 is retained in the locking position, i.e. in the position shown to the left in FIG. 5, resting in said recess and against the web 35. To the needle holder 28 a stopper piece 33 is fixed at a distance below the actuating pin 32 and so as to laterally protrude, said stopper piece in the locking position located closely under the web 35. Advantageously, the stopper piece 33 has a thread guide lug 41 for the upper thread 10.

Figure 3:
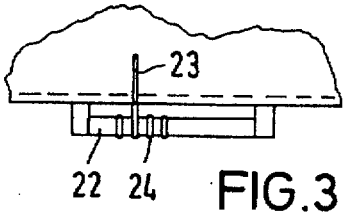
FIG. 3 is a partial front view in the direction of arrow III in FIG. 1.
Figure 4:
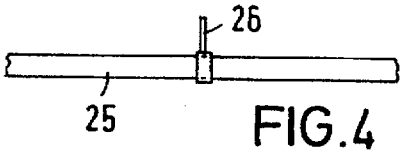
FIG. 4 is a partial view in the direction of arrow IV in FIG. 1.

As shown in the upper left portion of FIG. 1 and in a simplified form in FIG. 3, at least one depository bar 22 is provided in the upper portion of the machine frame for needles which are out of action together with the needle holder and the respective upper thread 10. If plural needle bars are provided it will be expedient to correspondingly provide plural depository bars which, in order to be better surveyed, are spaced one above the other. The essential advantage of said depository bars in that the upper thread, upon quick release of the needle holder, can remain in the needle eye at the time of depositing the needle holder on the depository bar so as to be readily available for later use in the operative position. For easy handling the depository bar 22 is provided with suitable clamping, catching or plug-in holders 24.

As already mentioned above, a quick-locking means is provided also between the looper holder 36 and the looper shaft 13. One embodiment is represented by FIG. 7. According to this embodiment the quick-locking means comprises a locking strap 38 which by means of a pivot pin 37 is hinged to the looper holder 36 and grips around a part of the looper shaft 13. Expediently, the outer portion of the locking strap 38 is formed to be resilient so as to resiliently rest against the chamfering surface 40 of the looper shaft 13. For easy manipulation the end of the locking strap 38 is provided with a handle 39.

In the embodiment according to FIG. 7, the quick-locking means is provided between the looper holder 36 and the looper shaft 13. However, there may be instead provided also a manually operated plug-type locking means, for example in the form of a bayonet catch, which is not shown in the drawings.

Corresponding to the depository bar 22 for the needles and needle holders there is provided in the lower portion of the machine frame at least one depository bar 25 for those loopers 26 respectively 16 which are out of action. Also in this depository bar the loopers or the looper holders can be deposited together with the respective under thread 21 so that in this case, too the under thread needs not be cut through prior to dismounting the looper or looper holder and, therefore, is readily available for later remounting.

I claim:

1. A multiple-needle sewing machine comprising at least one needle bar and means for fixing the individual needles as well as at least one looper shaft to which looper holders with the loopers are fixed, wherein manually operated quick-locking means are provided between each needle or a needle holder of each needle and the needle bar and/or between the looper holder of each looper or each looper and the looper shaft to dismount each needle or each needle holder for each needle and/or each looper or each looper holder for each looper.

2. A multiple-needle sewing machine according to claim 1, characterized in that the quick-locking means for each needle comprises a longitudinal guide for the needle holder provided on the needle bar, an actuating pin on the needle holder pivotable in a direction transverse of the longitudinal guide, and a lock-in position for the actuating pin so that in a first pivot position of the actuating pin the needle holder can be pushed into the longitudinal guide and in a second pivot position the actuating pin is locked to the needle holder in the longitudinal direction.

3. A multiple-needle sewing machine according to claim 2, characterized in that the longitudinal guide is formed of a notch in the needle bar which is approximately triangular in cross-section and of a locking plate covering said notch so that the needle holder rests against and is supported on three generating lines which extend longitudinally and are distributed on the circumference of the needle holder.

4. A multiple-needle sewing machine according to claim 3, characterized in that the locking plate comprises a laterally open semi-circular recess for the lock-in position a consecutive slot and a springy web formed thereby so that the actuating pin in the locking position is held within said recess and so as to rest against said web.

5. A multiple-needle sewing machine according to claim 4, characterized in that to the needle holder a stopper piece is fixed at a distance below the actuating pin and so as to laterally protrude, said stopper piece in the locking position closely under the web.

6. A multiple-needle sewing machine according to claim 5, characterized in that the stopper piece comprises a thread guide lug for the upper thread.

7. A multiple-needle sewing machine according to claim 1, characterized in that in the upper portion of the machine frame of said machine at least one depository bar is provided for needles which are out of action together with the needle holder and the respective upper thread.

8. A multiple-needle sewing machine according to claim 7, characterized in that the depository bar is provided with clamping, catching or plug-type holders.

9. A multiple-needle sewing machine according to claim 1, characterized in that the quick-locking means comprises a locking strap between the looper holder and the looper shaft, which locking strap is hinged to the looper holder by means of a pivot pin and grips around a part of the looper shaft.

10. A multiple-needle sewing machine according to claim 9, characterized in that the outer portion of the locking strap is formed to be resilient and is provided with a handle on the end thereof.

11. A multiple-needle sewing machine according to claim 1, characterized in that in the lower part of the machine frame of said sewing machine at least one depository bar is provided for the loopers.

12. A multiple-needle sewing machine according to claim 11, characterized in that the loopers containing means for guiding the respective under thread.

* * * * *